United States Patent [19]

Taylor

[11] 4,087,907

[45] May 9, 1978

[54] APPARATUS FOR FEEDING CABLE WIRES THROUGH AN ELECTRICAL CONNECTOR GROMMET

[75] Inventor: Billy E. Taylor, Richardson, Tex.

[73] Assignee: Rockwell International Corporation, El Segundo, Calif.

[21] Appl. No.: 743,563

[22] Filed: Nov. 22, 1976

[51] Int. Cl.[2] ..... H01R 43/00

[52] U.S. Cl. ..... 29/721; 29/235; 29/450; 29/754; 29/760

[58] Field of Search ..... 29/752, 754, 760, 721, 29/235, 450, 630 A, 630 F, 630 R; 140/93 R

[56] References Cited

U.S. PATENT DOCUMENTS

| | | | |
|---|---|---|---|
| 2,657,454 | 11/1953 | Huyett | 29/754 X |
| 2,683,924 | 7/1954 | Schryver | 29/754 |
| 3,336,650 | 8/1967 | Bosler et al. | 29/721 |
| 3,555,674 | 1/1971 | Aileo et al. | 29/450 X |

*Primary Examiner*—Carl E. Hall

*Attorney, Agent, or Firm*—Howard R. Greenberg; H. Fredrick Hamann

[57] ABSTRACT

Cable wires are fed through the individual apertures of an electrical connector grommet by first sliding the grommet over a fixed array of tubular pins patterned such that each pin is inserted in an individual aperture, then passing the wires through the pins occupying their respective grommet apertures and thereafter slidably removing the grommet from the pin array.

9 Claims, 3 Drawing Figures

12
14
10
16
18
20
22
24
26
24
26
44
46
46
10
48
48
42
42
40
38
32
34
36
30
52
54
56
56
28

APPARATUS FOR FEEDING CABLE WIRES THROUGH AN ELECTRICAL CONNECTOR GROMMET

BACKGROUND OF THE INVENTION

The present invention pertains generally to electrical cable connectors and particularly to moisture seal grommets employed therein.

To enhance the reliability of connectors used for terminating the electrical wires of a cable, it is not uncommon to insulate the soldered connections of the wires with the connector pins from harmful moisture conditions through a moisture seal grommet having an aperture pattern which matches the pins so that it fits thereover. Because of the small diameter of the grommet apertures, the friction presented to the insulated wires as they are individually passed therethrough (the grommets being made from rubber or some similar material) and the multitude of wires normally found in an individual cable (which can therefore be quite heavy as well as complex), feeding the wires through the apertures can pose a formidable task to a human operator who must hold the grommet by hand during the feeding operation and be continually wary that each coded wire is inserted in its appropriate aperture.

With the foregoing in mind, it is a primary object of the present invention to provide a method and apparatus for feeding cable wires through the individual apertures of an electrical connector grommet.

It is a further object of the present invention to provide such a method and apparatus which will facilitate proper positioning and feeding of the cable wires by a human operator.

The foregoing objects as well as others, and the means by which they are achieved through the present invention may best be appreciated by referring to the Detailed Description of the Preferred Embodiment which follows hereinafter together with the appended drawings.

BRIEF DESCRIPTION OF THE INVENTION

In accordance with the stated objects, the present invention facilitates feeding cable wires through the individual apertures of a connector grommet by first emplacing the grommet on an array of tubular pins patterned to match its own aperture pattern so that each pin is inserted in an individual one of its apertures. Each rigid pin expands its respective aperture ever so slightly so that an insulated wire may be easily passed through while also affording less friction resistance to passage of the wire than would be presented by the grommet itself. After all of the wires are fed through and out the other side of the tubular pins, the grommet is slid off the array leaving the wires in their respective apertures as desired.

To assist the human operator performing the feeding operation, a fixture is used in which the tubular pin array is embedded in a plate that is mounted on posts attached to a base so that the wires may be fed from the top of the plate while exiting from its underside. A second plate is placed on top of the first plate before the grommet is emplaced on the pin array, with at least one aperture being provided therein to permit the pins to extend therethrough to receive the grommet. The configuration is such that the second plate cannot be separated from the first plate without likewise separating the grommet from the pin array, which permits the operator to slidably remove the grommet after feeding all of the wires through their respective grommet apertures without a great deal of effort. To assist the operator in properly positioning all of the wires in their respective apertures, the fixture affords a place for accommodating a graphic display of the wiring pattern easily viewable by the operator.

DETAILED DESCRIPTION OF THE PREFERRED EMBODIMENT

Figures 1, 2:
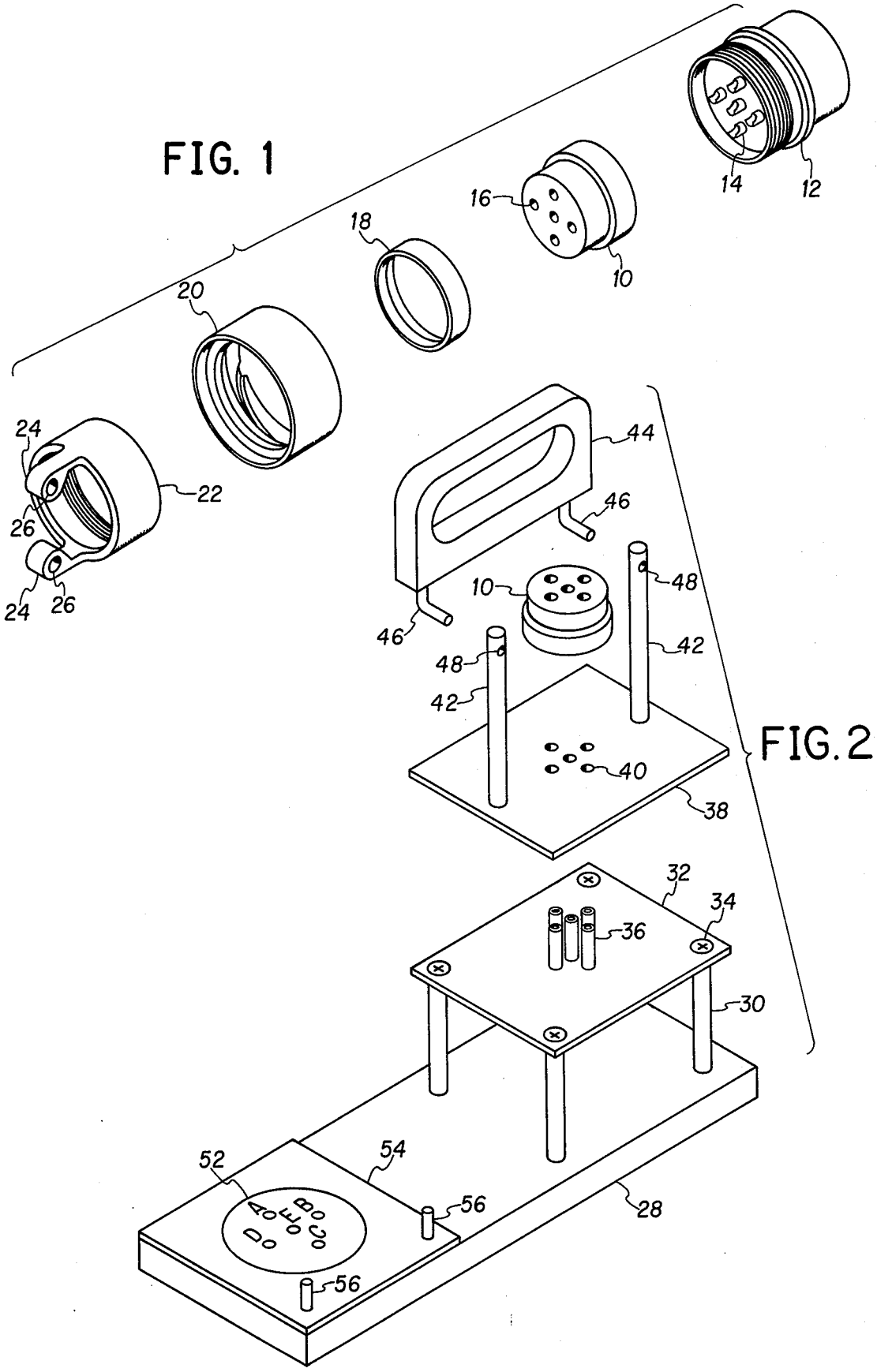
FIG. 1 is an isometric view of a disassembled electrical cable connector with all of its parts properly juxtaposed with respect to one another just prior to assembly and which includes a typical grommet with which the invention is intended to be used.
FIG. 2 is an isometric view of the fixture apparatus of the invention with its components also disassembled and juxtaposed with respect to one another just prior to assembly preparatory to initiation of the cable wire feeding operation.

A typical electrical cable connector having a weather seal grommet with which the subject invention is intended to be used is depicted in FIG. 1, wherein disassembled components are integrated into the connector assembly by moving each one sequentially to the right. Thus, the grommet 10 is inserted in the threaded female connector 12 having a plurality of electrical pins 14 which extend through its entire length for terminating the electrical wires of the cable (which would be passed through all of the components of the connector from the left) by solder connections thereto. The grommet 10 has a plurality of apertures 16 having a pattern that matches that of the electrical pins 14 so that upon assembly each pin 14 occupies a single aperture 16. Thus, it is necessary prior to assembly of the connector to feed the individual wires of the cable through their appropriate apertures 16 of grommet 10. Once in place, the grommet 10 insulates the solder connections of the wires to pins 14 from the detrimental effects of moisture conditions. The connector assembly is completed by encircling the grommet 10 with a plastic ring 18 after which threaded coupler 20 is fitted over female connector 12 for later engaging the male connector (not shown) which mates with the female connector 12 from the right of FIG. 1, after which member 22 is screwed onto the threads of female connector 12 to hold the assembly together. Member 22 has extension arms 24 with apertures 26 for accommodating screws that are used to tighten a clamp (not shown) around the cable or cables which are being terminated with the electrical connector.

As previously alluded to under the Background of the Invention, feeding the individual cable wires through the apertures 16 of grommet 10 can be a formidable task for the human operator who must hold the grommet 10 by hand while making sure that the proper coded wires are passed through the narrow apertures 16 which present a high friction resistance to the wire passage therethrough. This is greatly exacerbated by the multitude of wires which normally comprise a cable thus adding to the weight which must be supported as well as the complex wiring pattern which must be accommodated.

Figure 3:
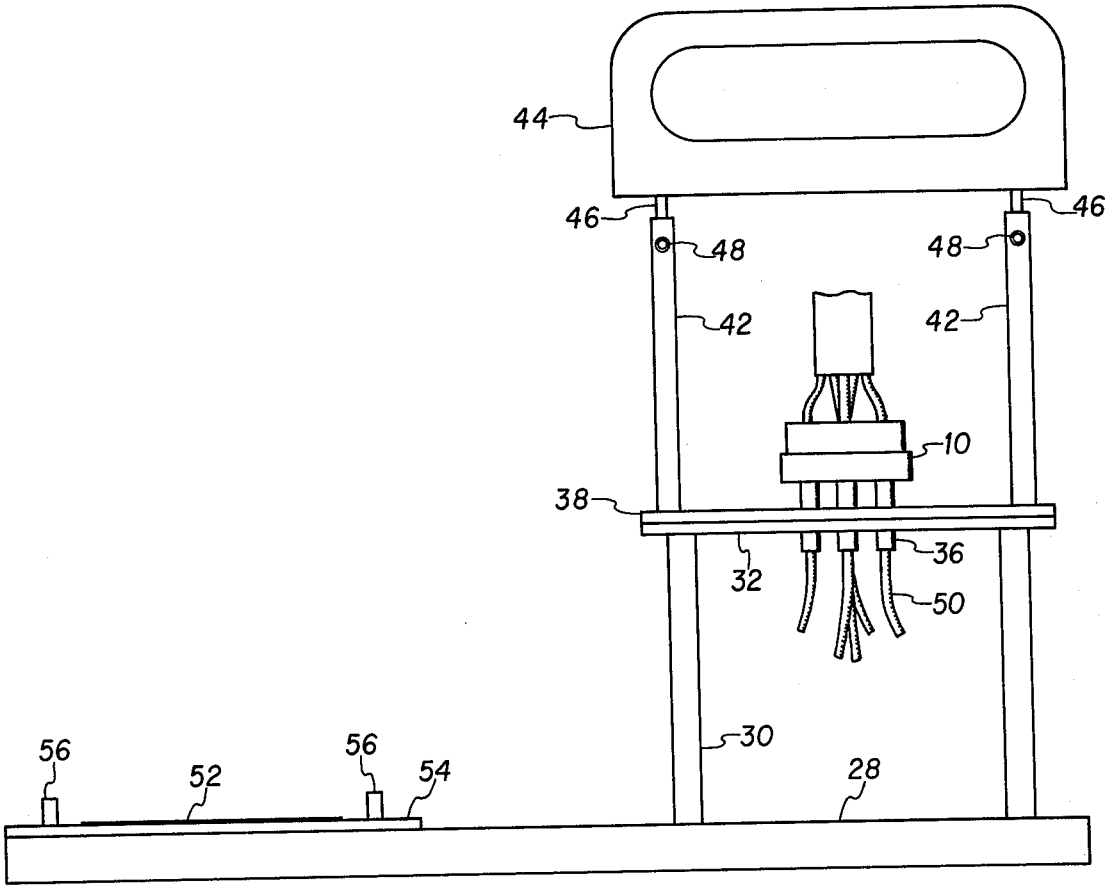
FIG. 3 is an elevation view of the fully assembled fixture apparatus with all of the cable wires passing through the grommet apertures just prior to removal of the grommet.

The present invention obviates the foregoing feeding operation difficulties in two ways, namely, by providing a fixture which eliminates the need for a human operator to hold the grommet while feeding the wires through the apertures thereof and facilitating the actual wire feeding itself. The fixture apparatus, which is shown in FIGS. 2 and 3 (the same reference numbers being used in both), comprises a base 28 for supporting four posts 30 on which is mounted a plate 32 affixed thereto with screws 34. In the center of plate 32 is an array of tubular pins 36 embedded therein in any desired manner and passing therethrough. Although the pins 36 are shown extending out from both sides of plates 32, it will be appreciated hereinafter that they need only extend out from the top surface sufficiently so that the grommet 10 may be emplaced thereon after a second plate 38 is placed over plate 32. Plate 38 has a plurality of apertures 40 having a pattern which matches that of the pin array so that each pin 36 passes through an individual aperture 40 when plates 32 and 38 are placed against one another. The pin array is patterned such that each pin 36 occupies an individual aperture 16 of grommet 10 when it is emplaced on the array after juxtaposition of plates 32 and 38. The diameter of the pins 36 is preferably equal to or just slightly larger than that of apertures 16 so that upon emplacement of the grommet 10, the resilience of its material (being rubber or some equivalent) permits the apertures 16 to be expanded ever so slightly to facilitate the feeding of the cable wires.

Attached to plate 38 are two posts 42 on which is mounted a handle 44, preferably not permanent and without the use of any mechanical fasteners so that it can be attached and detached facilely without the use of any tools. This may be accomplished through the use of L-shaped pins 46 which screw into handle 44 and are inserted into apertures 48 of posts 42 from the back in the views of FIGS. 2 and 3. The facile detachment of handle 44 affords a human operator easy access to the area above the emplaced grommet 10 when feeding the cable wires 50 through the tubular pins 36 inserted in apertures 16.

Although it is recognized that grommet 10 could be removed by hand from the pin array after the wire feeding is completed, the plate 38 is preferably used to perform this function since the force encountered by virtue of the weight of the cable and the friction between the pins 36 and apertures 16 can be considerable, thereby rendering it burdensome to develop sufficient leverage with only the fingers of the hand. Thus, the grommet 10 is removed by first emplacing the handle 44 on the posts 42 and then lifting up thereon which affords the operator a greater gripping area than on the grommet 10 itself. With the cable wires 50 extending below the plate 32, they will tend to remain in the apertures 16 once the grommet 10 is completely separated from the pin array. Thereafter, the grommet 10 together with the inserted wires 50 can be separated from the plate 38 by manually pulling it away. It is to be pointed out that although the plate 38 is shown as having an individual aperture 40 for each pin 36, fewer apertures can be employed so long as all of the pins 36 of the array are enabled to pass therethrough upon juxtaposition of the plates 32 and 38 and they are configured so that the plate 38 cannot be separated from plate 32 without likewise separating the grommet 10 from the pin array. In this regard, even one large aperture having a diameter equal to the outer diameter of the pin array may be employed so long as it is less than the diameter of the grommet 10.

To aid the human operator in properly positioning the normally coded wires 50 in the apertures 16 of the grommet 10, provision is made in the fixture apparatus for conveniently placing a graphic display 52 (using a letter code to show into which aperture 16 each lettered wire is to be inserted) adjacent the feeding operation area easily viewable by the operator. The display 52 may be placed on a panel 54 which is retained in place by pegs 56. Thus, whenever a grommet 10 having a different aperture pattern is to be put through the feeding operation, the graphic display 52 for the wiring can easily be changed along with the plates 32 and 38 naturally.

As the foregoing description demonstrates, the invention herein relieves the human operator of the burden of having to hold a grommet while manipulating cable wires, particularly a multitude thereof, through its individual apertures. Moreover, the passage of the wires is greatly facilitated by the use of the pin array which allows the wires to traverse the apertures with less friction resistance than otherwise. Since no doubt the foregoing preferred embodiment can be modified by those skilled in the art without departing from the scope and spirit of the invention, the Detailed Description herein is intended to be merely illustrative and not circumscriptive of the invention as it will now be claimed hereinbelow.

What is claimed is:

1. Fixture apparatus for facilitating the feeding of cable wires through the individual apertures of an electrical connector grommet, comprising:

a first flat plate mounted on a support base an array of tubular pins embedded in said first plate so that they pass therethrough an extend out from at least one of its surfaces, patterned for individual insertion of the pins in individual apertures of the grommet;

a second flat plate having a thickness which is less than the length of the extended portions of said pins and at least one aperture traversed by said pins when said second plate is placed over said first plate, configured such that when the grommet is thereafter emplaced on said array at least a portion of the grommet contacts the surface of said second plate so that said plates cannot be separated by moving the second plate away from the first without likewise separating the grommet from said array, and said second plate including a handle and means for attaching said handle to said second plate.

2. The apparatus of claim 1 wherein said second plate has as many apertures as said pins with each pin passing through a different one of the apertures.

3. The apparatus of claim 4 wherein said means comprises a pair of posts laterally affixed to one surface of said second plate and said handle is mounted thereon.

4. The apparatus of claim 3 wherein said handle is detachably mounted on said posts without the use of any mechanical fasteners.

5. The apparatus of claim 1 including a base having a plurality of posts on which said first plate is mounted.

6. The apparatus of claim 5 including screw fasteners for mounting said first plate on said posts.

7. The apparatus of claim 5 including graphic means displaying the pattern of apertures of the grommet and the arrangement of wires to be fed therethrough and wherein said base has means for accommodating said graphic means.

8. The apparatus of claim 3 including a base having a plurality of posts on which said first plate is mounted.

9. The apparatus of claim 8 including graphic means displaying the pattern of apertures of the grommet and the arrangement of wires to be fed therethrough and wherein said base means for accommodating said graphic means.

* * * * *

UNITED STATES PATENT AND TRADEMARK OFFICE

CERTIFICATE OF CORRECTION

PATENT NO. : 4,087,907

DATED : May 9, 1978

INVENTOR(S) : Billy E. Taylor

It is certified that error appears in the above-identified patent and that said Letters Patent are hereby corrected as shown below:

IN THE SPECIFICATION

Column 1, line 28, delete "a method and" and substitute therefor -- an --.

Column 1, line 32, delete "a method and" and substitute therefor -- an --.

IN THE CLAIMS

Column 4, line 36, after "base" insert -- ";" --.

Column 4, line 58, after "claim" delete "4" and substitute therefor -- 1 --.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*